United States Patent [19]

Schwartz

[11] 4,154,570

[45] May 15, 1979

[54] GASEOUS MOLECULAR SEAL FOR FLARE STACK

[75] Inventor: Robert E. Schwartz, Tulsa, Okla.

[73] Assignee: John Zink Company, Tulsa, Okla.

[21] Appl. No.: 832,218

[22] Filed: Sep. 12, 1977

[51] Int. Cl.[2] ..... F23D 13/20

[52] U.S. Cl. ..... 431/202; 98/60; 431/5

[58] Field of Search ..... 431/202, 5; 98/60; 23/277 C; 60/296

[56] References Cited

U.S. PATENT DOCUMENTS

| | | | |
|---|---|---|---|
| 3,289,729 | 12/1966 | Reed | 431/202 |
| 3,578,892 | 5/1971 | Wilkinson | 431/202 |
| 3,662,669 | 5/1972 | Culliname | 431/202 |

*Primary Examiner*—Edward G. Favors

*Attorney, Agent, or Firm*—Head, Johnson & Chafin

[57] ABSTRACT

An improved molecular seal for installation in a flare stack system designed for burning of waste gases of lesser density than air, and for installation at an intermediate point in the flare stack, comprising a housing of larger cross-section than that of the flare stack, the housing being closed by plates at both ends with an outlet conduit sealed through the plate at the outlet end of the housing, and connected to the flare stack. An inlet conduit is sealed through the inlet end of the housing and is connected to the source of waste gases. Inside the housing the two conduits are deflected past each other so that they are substantially parallel, and have their axes in the same plane. The downstream end of the inlet conduit goes to a higher elevation inside the conduit than the upstream end of the outlet conduit.

11 Claims, 8 Drawing Figures

IMPROVED GASEOUS MOLECULAR SEAL FOR FLARE STACK

BACKGROUND OF THE INVENTION

1. Field of the Invention

This invention lies in the field of combustion of waste or dump gases in flare systems. More particularly, it concerns means for preventing the downward movement, beyond a selected point, of atmospheric air into the flare stack system, when the flow of lighter-than-air combusible gases is terminated.

2. Description of the Prior Art

In carrying out some industrial processes, gases, such as hydrogen, light hydrocarbons, and other gases, are often produced. These gases are customarily employed for useful purposes but, on occasion, or as result of some emergency, it is necessary to vent such gases to the atmosphere. These dump, or waste, gases are delivered into the lower portion of a vertically disposed flare stack so that the gases ultimately are released at a significant elevation above the surrounding terrain. Such gases are burned at the upper end of the stack as is well known in the art.

These dump gases are generally lighter-than-air, and have a molecular weight of 28 or less. Many of the gases, upon limited mixture with air, form explosive mixtures. It is, therefore, important to avoid the presence of air below a limited upper portion of the flare stack system to avoid conditions which might promote accidental explosions.

In the prior art it has been customary to inject at the base of the stack a constant, but limited, flow of lighter-than-air purge, or sweep, gases to make sure that there is always flow of gases within the system toward the burning point of the flare, when minor temperature change occurs within the flare. Such additional gas injection is optional, except for major temperature changes in the gas content of the flare. In such cases separate means, such as shown in U.S. Pat. No. 3,741,713, can be adopted to compensate for gas temperature change within the flare system.

SUMMARY OF THE INVENTION

It is a primary object of this invention to provide a molecular seal, by means of which it is possible to limit the entry of atmospheric air into the top end of a flare stack, and into a selected portion of the molecular seal.

It is a further object of this invention to prevent the progress of air farther into the molecular seal, so as to avoid the mixture of air with the waste gases which might form explosive-gas mixtures.

The operating principle of all molecular seals is based upon the fact that, when a chamber is filled with a gas that is lighter than air, the pressure in the chamber at the top (static pressure) is greater than the pressure in the chamber at the bottom, and that the static pressure at a point halfway up (or down) the chamber is an average pressure, or that the static pressure increases with upward position in the chamber and decreases with downward position.

Because of this pressure state within the vessel, entry of gas above the center of the vessel and exit of gas from the vessel from a point below the center of the vessel, puts a pressure barrier between entry and exit, which prevents the reversed or abnormal flow of gas through the vessel. That is, it prevents the backward flow of atmospheric air down the stack and into and through the molecular seal.

The chamber, or housing, of the molecular seal can be either vertically oriented or horizontally oriented. The important thing is that the downstream end of the inlet pipe must terminate inside the chamber at a higher elevation than the inlet opening of the outlet pipe inside the chamber. Thus, the normal direction of gas flow of lighter-than-air gases through the molecular seal, from the source of waste gases, is into the inlet pipe to the highest elevation within the housing, then with a reversal in direction in the plenum of the housing, downward movement into the inlet opening of the outlet pipe, and thence to the stack.

Following this principle, the pressure in the chamber or housing is higher at the higher elevation near the outlet end of the inlet pipe, than is the pressure near the bottom of the chamber, or housing, at the inlet end of the outlet pipe.

These and other objects are realized and the limitations of the prior art are overcome in this invention by providing a molecular weight created trap in the flare stack near the top thereof, wherein the normal flow of dump gases is upwardly in the flare stack to the bottom of a housing of larger diameter than the fare stack. This housing is closed off by plates on the bottom and top ends. There is an inlet conduit sealed through the bottom plate, which extends into the housing to a point near the upper end of the housing. There is an outlet pipe which is sealed through the top plate and extends downwardly to a point near the bottom end of the housing, whereby the downstream end of the inlet conduit is at a higher elevation inside the housing, or chamber, than is the upstream end of the outlet conduit, which is close to the lowest point of elevation inside of the housing.

Gas flow from the source of waste gases comes by way of the inlet pipe into and through the lower wall of the housing and up almost to the top plate of the housing. The gas flows out of the outlet end of the inlet pipe, and then downwardly inside of the plenum of the housing, and into the inlet end of the outlet conduit, which then goes to the stack where the waste gases are burned.

The inlet and outlet conduits enter along the axis of the cylinder, and then inside of the housing they are deflected at a selected angle, so that they pass each other with a selected small clearance, and are parallel, with both axes in a given diametral plane of the housing. In this way they extend beyond each other, the inlet pipe going near the top of the plenum and the outlet pipe going down near the bottom of the plenum. If desired, the inlet and outlet pipes as they enter the plenum inside the housing may be deflected by 90° to an outer radius and then deflected again parallel to the axis of the housing, to the upper end of the plenum. Likewise, the outlet pipe entering through the axis of the housing at the top is deflected by 90° through a radial conduit, and then deflected again by 90° through a portion of the conduit which is close to the inner surface of, and parallel to, the wall of the housing.

Based on the above principle, the pressure inside the housing near the top of the plenum may be labelled "$P_1$" and is greater than the pressure $P_2$ near the bottom of the plenum inside the housing. This does not interfere with the normal flow of dump gases through the molecular seal since all the entire seal and inlet and outlet pipes are filled with the same gas. However, when the flow of dump gases ceases, and is no longer carried to the inlet of the seal, and the gases in the seal are static, air can be present within the normal exist conduit because of its greater specific gravity. This causes it to fall inside of the outlet conduit, displacing the lighter-than-air waste gases, which, because of their buoyancy, flow upwardly through the flare stack to the atmosphere.

While air may fill the outlet conduit due to this buoyant flow of lighter-than-air gas, it must not proceed beyond a certain position in the molecular seal, because it would dangerously complicate the situation by mixing with and forming an explosive combination with the waste gases. However, when the air entering the outlet conduit at the top, or downstream end, passes down the outlet conduit to its upstream end, it must then reverse in flow direction, and go upwardly in order to reach the opening of the inlet conduit. However, because of the reversed pressure gradient, that is where the upper pressure $P_1$ is greater than the lower pressure $P_2$, the dense air cannot advance upwardly against this reverse pressure, and so must remain near the contact interface between the entered air and the lighter-than-air gas inside the chamber, which is near the lowest end of the outlet conduit.

Since air can flow only from higher to lower pressure, the air cannot flow back through the seal because of the reverse pressure conditions, which, for entering air flow, presents any potential entering air (in reverse of normal flow) with pressure conditions reversed to those required for flow.

The invention consists of a chamber of any shape, preferably round, with end closures which are pierced at both ends, with inlet and outlet conduits entering bottom and top ends, respectively, which continue on within the chamber or housing, to open ends. The normal inlet duct termination is always at a significant elevation above the termination of the normal outlet duct. The inlet duct terminates above the center line of the space between the inlet and outlet ducts, and the outlet duct terminates below the centerline for normal flow, and $P_1$ is always, due to gas buoyancy effect, greater than $P_2$ by a measurable amount, which is measured in inches of water column. As an example, if the lighter gas should be methane (molecular weight 16) versus air (molecular weight 29), which is typical, and, if the entry duct terminates four feet above the outlet duct termination, the difference $P_1$ and $P_2$ would be 0.019WC, with the greatest pressure $P_1$ for a static condition of flow.

BRIEF DESCRIPTION OF THE DRAWINGS

These and other objects and advantages of this invention and a better understanding of the priciples and details of the invention will be evident from the following description taken in conjunction with the appended drawings, in which.

DESCRIPTION OF THE PREFERRED EMBODIMENT

Figure 1:
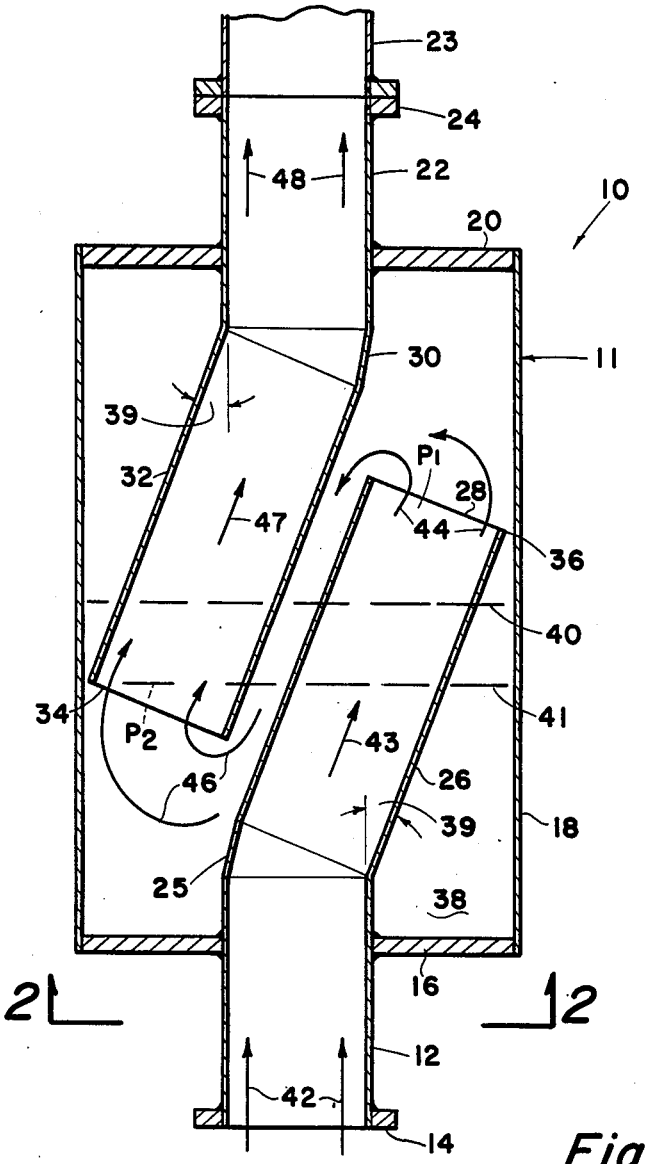
FIGS. 1 and 2 represent, in cross-section, a vetically-arranged embodiment of this invention.
Figure 2:
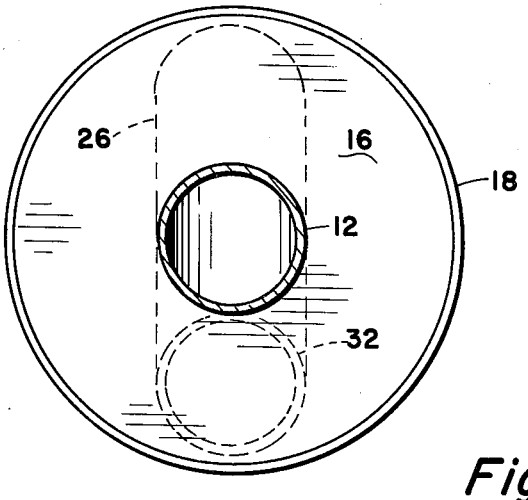

Referring now to the drawings and, in particular, to FIGS. 1 and 2, there is shown one embodiment of this invention indicated generally by the numeral 10. It comprises a chamber, or housing, 11, which includes a cylindrical outer wall 18, and two end plates 20 at the top, and 16 at the bottom. An inlet conduit or pipe 12 provided with a coupling flange 14, enters along the axis of the housing through the bottom plate 16, to which it is welded. There is an angular portion 25 of the conduit, to which a third portion 26 of the conduit is attached as by welding.

The third portion 26 is tilted at an angle 39 which is the angle of the intermediate, or second portion 25. The inlet conduit terminates with its downstream end 28 at a position above the vertical center 40 of the housing 11.

Similarly, an outlet conduit 22 carrying a coupling flange 24, which is connected to the flare stack 23, is inserted downwardly through an axial opening in the top end plate 20. Like the inlet conduit this outlet conduit is deflected through an angle 39 by means of an angular section of conduit 30, and a third portion 32 which extends downwardly with its inlet end below the vertical center 40 of the housing. In general, it is preferable to have the downstream end 28 of the inlet conduit 12 at as high as elevation inside the housing as possible and, similarly, to have the inlet end 34 of the outlet conduit 22 at as low as elevation inside the housing as possible, so that the difference in elevation between the two ends is as great a distance as possible.

The entering lighter-than-air gas, which is provided by a source, not shown, but well known in the art, flows into the inlet conduit 12 in accordance with arrows 42, and then downstream (up) the portion 26 of the inlet conduit, to the open top 28 in the vicinity of the top of the plenum enclosed within the outer wall 18 of the chamber. The light-than-air gas (which will, for convenience, be called "lighter" gas) then reverses direction by approximately 180° in accordance with arrows 44 and flows downwardly inside the plenum 38 to a point below the open end 34 of the outlet conduit, where it again reverses direction by 180° and flows upwardly in accordance with arrows 46 through the open bottom 34 of the portion 32 of the outlet conduit, and then as arrows 47 and 48 up through the outlet conduit to the stack, not shown, and to the atmosphere.

So long as there is gas flow in accordance with arrows 42, the entire space within the inlet conduit through plenum 38, the outlet conduit in accordance with arrows 48, are filled with the lighter gas. The flow is continuous because the pressure at the inlet 14 is higher than atmospheric, causing the gas to flow through the molecular seal housing, and up the stack. While this flow continues, the velocity head of the flow of light gas prevents the reverse flow down the stack of the higher density air. However, when the flow stops, and the lighter gas within the system is static, because of the buoyancy of the lighter gas in the air, it will tend to rise, flowing up through the denser air, permitting air then to enter the top of the stack and to progress downwardly, until it reaches a point where the interface 41 between the air and the light gas is in the neighborhood of the open end 34 of the outlet pipe. In other words, air fills the entire outlet conduit and the remainder of the system, so far, is filled with lighter gas.

However, since there is a horizontal contact at the elevation of 34, with dense air above lighter gas, there will be further displacement flow upwardly through the air, of lighter gas in the space below the horizontal dash line 41, so that space 38 below 41 will be ultimately filled with air.

In view of the principle described previously, the pressure $P_1$ at the outlet of the inlet conduit will be at a higher pressure than $P_2$ at the position of the interface 41 between the dense air below and the ligher gas above and, therefore, further progress of the interface 41 upwardly by movement of additional air down through the outlet conduit into the space 38 will be prevented, because of the fact that the pressure $P_1$ is greater than $P_2$. This means that the further invasion of air into the molecular seal chamber and into the lower stack will be prevented and, therefore, there will be less opportunity for the formation of explosive gas mixtures.

FIGS. 1 and 2 illustrate a generalized construction of the molecular seal, in which two pipes enter a chamber with the inlet pipe extending to a higher elevation inside the chamber than the open bottom end of the outlet pipe.

Figure 4:
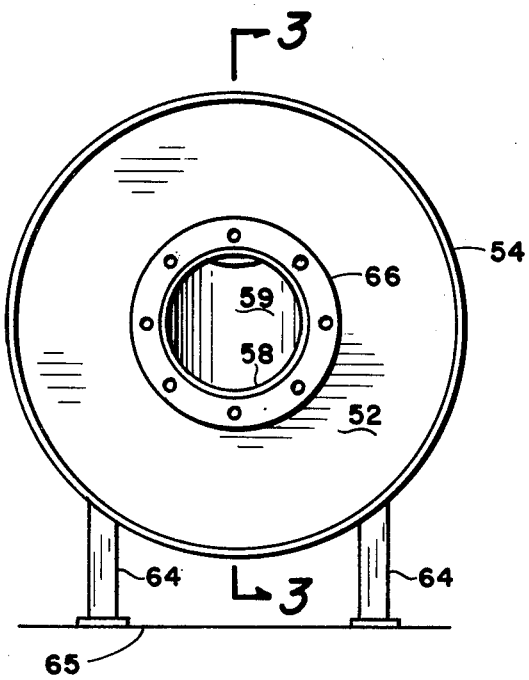
FIGS. 3, 4 and 5 represent in cross-section a horizontally-positioned embodiment of this invention.
Figure 5:
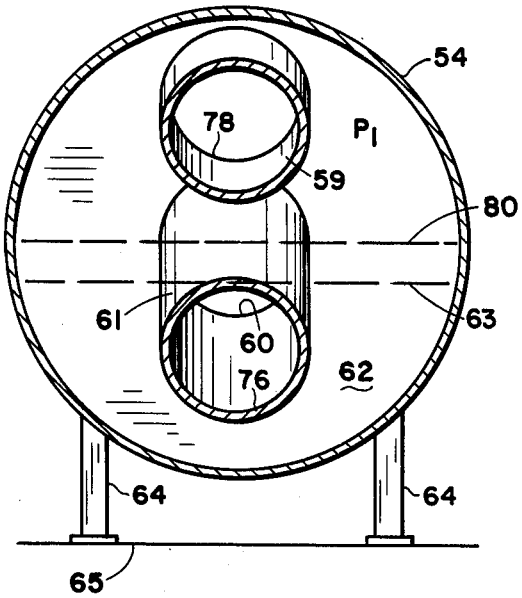
Figure 3:
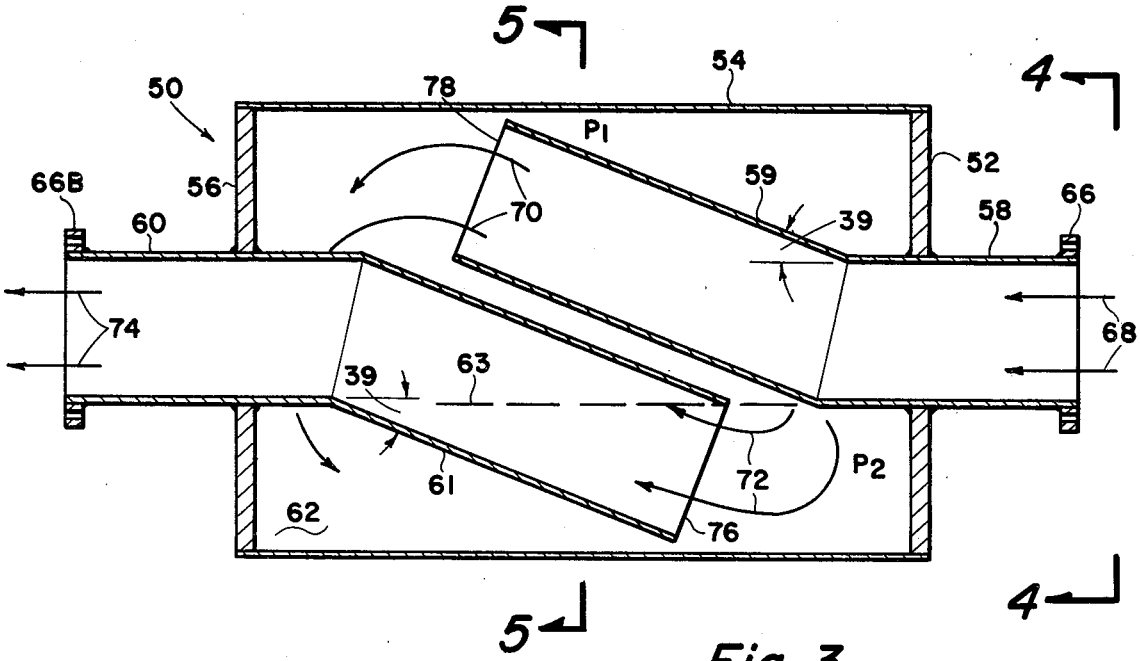

The embodiment of FIG. 1 is shown turned on its side in FIGS. 3, 4 and 5 to form the assembly 50 with the axis of the housing or chamber 54 horizontal. This may be because the construction of the flare system makes it more convenient to provide a horizontally-oriented chamber. However, the construction and action of the system is entirely similar to that of FIG. 1.

There is a cylindrical housing 54 with horizontal axis, and inlet conduit 58 with mounting flange 66, which enters through the axis of the end wall 52, and is deflected upwardly to its outlet end 78 near the top of the housing wall 54. Similarly, there is an outlet conduit 60 which enters through the center of the outlet wall 56. This conduit is deflected downwardly so as to pass the portion 59 of the inlet conduit. These two portions 59 and 61 are substantially parallel to each other and they lie with their axes in a diametral plane of the housing 50.

Inlet light gas flows in accordance with arrows 68 into the end 66 of the inlet conduit 58 and through the conduit 59 to the open end 78 thereof. The light gases then flow in accordance with arrows 70 downwardly and backwardly to enter the open end 76 of the outlet conduit of the portion 61 of the outlet conduit 60. This flow is in accordance with arrows 72, and further in accordance with arrows 74 out to the to coupling 66b and on to the stack.

Because of the displacement of the two ends 59 and 61 there is difference in elevation of the outlet end 78 of the inlet conduit, and the inlet end 76 of the outlet conduit, and this vertically disposed position of the two conduits acts in the same way as FIG. 1, to prevent the backward flow of air beyond a certain point inside the housing. For example, when the flow is as shown from the source into the housing and out to the left toward the stack, the entire system is under pressure greater than atmospheric, which forces the gas through and up the stack. When this flow is cut off upstream of the housing, the pressure, inside the system, of the light gas drops, the flow becomes static and the pressure drops back to atmospheric.

Since the stack has been filled with the lighter gas, the gas will flow upwardly through the air to the atmosphere and the air will flow down the stack, and back through the outlet pipe 60 and into the lower portion 62 of the housing 54 forming an interface at about the lever 63, indicated by the dash line. The pressure at the depth of this plane 63, namely $P_2$, is atmospheric and the pressure near the top of the housing is $P_1$, which, based on the principles previously stated, is higher than $P_2$ and, therefore, is no way in which air will advance further into the housing, lifting the plane 63, of conduit between the air and the light gas, so a static situation arises without further backflow of air.

Figure 6:
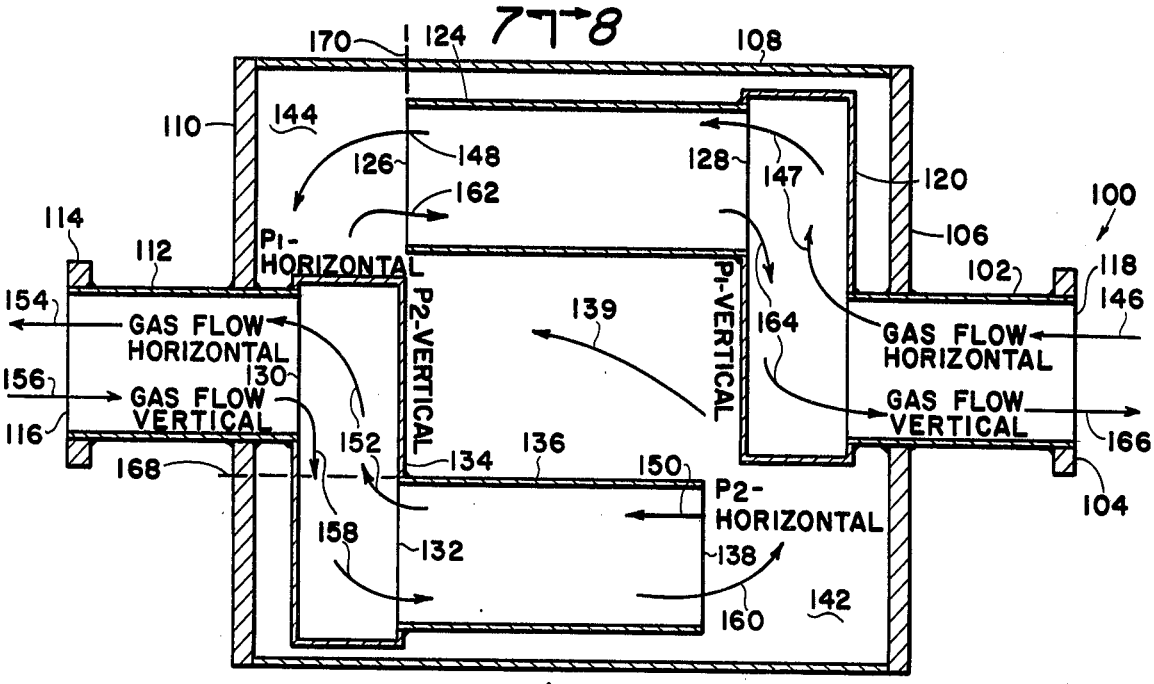
FIGS. 6, 7 and 8 represent a modified embodiment of this invention which can be utilized with an axis either horizontally or vertically oriented.
Figure 8:
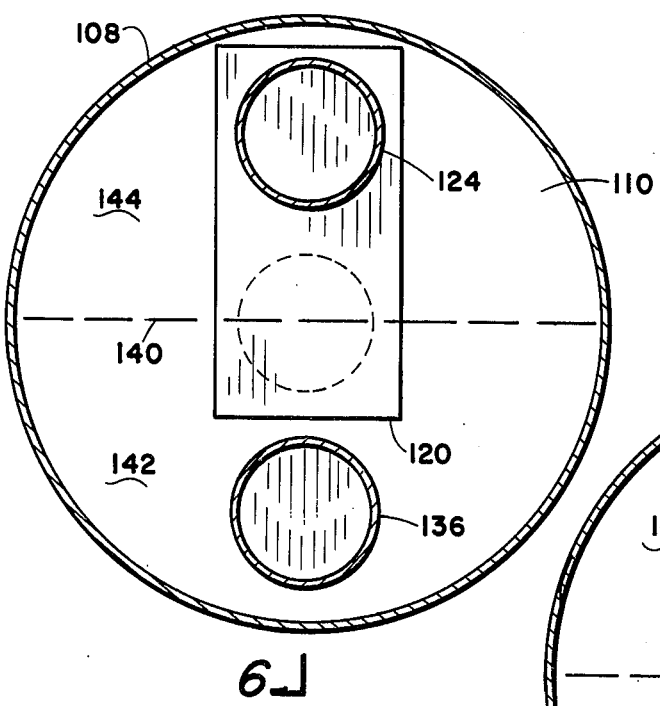
Figure 7:
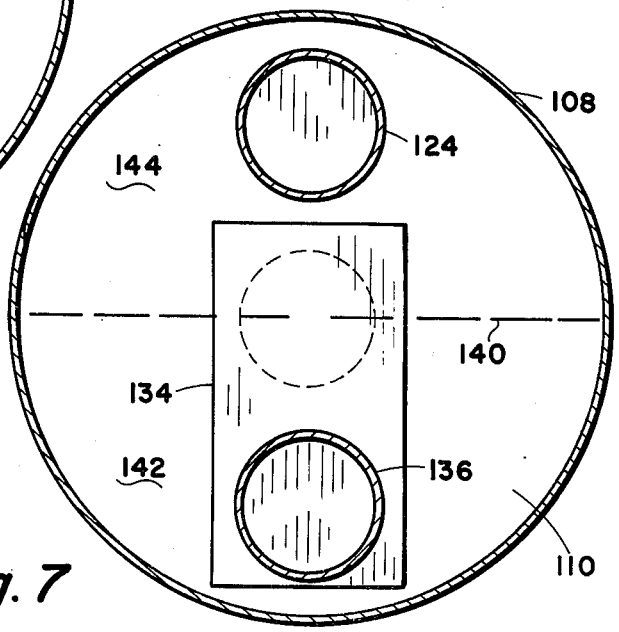

Referring now to FIGS. 6, 7 and 8, there is shown another embodiment, similar to that of fIG. 3 and also to that of FIG. 1. In this embodiment a circular cylindrical housing 108 is still used, and the inlet conduit 102 enters the housing through an axial opening. The conduit then has a second portion 120 which is directed vertically, radially, to a point near the outer wall 108, where there is a further right angle bend, and a cylindrical pipe or conduit 124 carries over to an open end 126.

The outlet pipe 112 enters the outlet end of the housing at its axis and then is offset downwardly by a radial portion 134, and then deflected through 90° to a cylindrical portion 136 which follows parallel to the outer wall 108. It is seen again, the outlet 126 of the inlet conduit 102 is positioned near the top of the housing 108, whereas the outlet pipes 112 has its inlet 138 positioned at the lower elevation of the bottom of the housing 108.

The flow of gas for a horizontal positioning of this FIG. 6 is shown by light gas entering in accordance with arrow 146, then being deflected outwardly and upwardly in accordance with arrows 147, and then horizontally in accordance with arrow 148, where the flow is then downwardly and into the open end 138 of the outlet pipe 136, horizontally in accordance with arrow 150, then vertically in accordance with arrows 152, and then horizontally 154, to the stack and to the flare. In this operation, it is similar to that of FIG. 3. In a similar way, when the flow of gas 146 is stopped, air will then come back down the stack and flow backwardly in the outlet pipe in the reverse direction of 154. Air will accumulate in the bottom portion 142 of the housing up to a lever 168 which corresponds to the top of the opening 138 of the outlet pipe 136, 112. Since the pressure $P_1$, marked "$P_1$ HORIZONTAL", at the bottom edge of the outlet end 126 of the inlet conduit 124 is higher than the pressure "$P_2$ HORIZONTAL" at the level of 168, there is no further tendency for the air in the space 142 to move upwardly, so the static interface remains at 168. Of course, there may be a molecular diffusion between the gases across this interface, but this is a relatively slow process.

By turning the drawing of FIG. 6 through an angle of 90° counterclockwise, it is seen that the construction is very similar to that of FIG. 1 where the pipes enter and leave the housing on the axis and are deflected in the region inside the housing, with the planes through the axes of the portions 136 and 124 being in a diametral plane of the housing 108. In this position, the gas flow enters pipe 112 in accordance with arrow 156 marked "gas flow-vertical" and flows in accordance with arrows 158 and then through the outlet end 138 of the inlet conduit 136. The flow of light gas is then downwardly in accordance with 139 and then up and into the lower end 126 of the outlet conduit 124 in accordance with arrows 162, through arrows 164 out through the axial conduit 102, and in accordance with arrows 116 to the stack and to the flare.

Based on the same discussion as that for FIG. 1, it will be seen that when the flow of light gases 156 is stopped and the light gas is static inside the system, then the air will progress downwardly through the stack and into the outlet pipe 102 and down to the level of the horizontal plane 170 of the lower end 126 of the outlet pipe, and because the pressure "$P_2$ VERTICAL" at that point is lower than the pressure "$P_1$ VERTICAL" at the top of the inlet pipe, there will be no further tendency for that interface 170 to move upwardly.

FIGS. 7 and 8 show views taken across the plane 7—7 and 8—8, respectively, indicating the construction of the conduits inside of the housing. These can be rectangular conduits 120, 134 into which the round pipes 124 and 136 are inserted and welded or they can be mitered joints of round pipes, or they can be deflected pipes or angularly oriented pipes as in FIGS. 1 and 3. The important condition, however, is that, no matter how the housing is oriented, the outlet end of the inlet conduit inside of the housing must be at a higher elevation than the inlet end of the outlet conduit.

It is clear that the diameter of the housing must be considerably greater than the diameter of the inlet and outlet conduits in order to permit a lateral position for these two pipes inside of the housing. However, the full diametral width of the housing in a direction perpendicular to the plane of the two pipes is not required, and the housing 108 instead of being circular, can be rectangular, or elliptical, or some similar shape, particularly if space and weight are an important factor. For a rectangular cross-section the wide faces would be parallel to the plane through the two conduits. Similarly, for an elliptical cross-section the plane of the major axis would coincide with the plane of the two pipes.

It will be clear also that, if this device is to be used in a horizontal position, as shown in FIG. 6, the inlet pipe 102 could enter the wall 106 at a point near the upper circumference of the wall, in a position where the pipe 124 would be a linear extension of the pipe 102. There would be no need for the right angle construction of the portion 120. Similarly, the outlet pipe 112 could enter the wall 110 at a point near the bottom circumference of the wall 110, where the portion 112 and 136 would be coaxial. In this case the right angle portions of the conduits 120 and 134 would not be required, so that a simpler construction would be provided. Of course, the same non-axial construction of the inlet and outlet pipes could be used in a vertical position as well as the horizontal position, and they could be used for the embodiments of FIGS. 1 and 3.

While the invention has been described with a certain degree of particularity, it is manifest that many changes may be made in the details of construction and the arrangement of components without departing from the spirit and scope of this disclosure. It is understood that the invention is not limited to the embodiments set forth herein for purposes of exemplification, but is to be limited only by the scope of the attached claim or claims, including the full range of equivalency to which each element thereof is entitled.

What is claimed:

1. In a flare stack system for the burning of waste gases, an improved gaseous molecular seal, for installation at an intermediate point in the flare stack system, comprising;

(a) a housing of larger cross-section than said flare stack, said housing closed by plates at both ends, a separate continuous outlet conduit sealed through the plate at the downstream end of said housing and connected to the flare stack; a separate continuous inlet conduit sealed through the plate at the upstream end of said housing and connected to the source of waste gases;

(b) said inlet conduit extending downstream inside said housing to a point intermediate the ends of said housing;

(c) said outlet conduit extending upstream inside said housing to a point intermediate the ends of said housing;

whereby the downstream end of said inlet conduit is at a higher elevation than the upstream end of said outlet conduit.

2. The molecular seal as in claim 1 in which said molecular seal is positioned with its axis vertical, with its inlet, conduit entering the bottom plate of said housing, and said outlet conduit leaving through the top plate of said housing.

3. In a flare stack system for the burning of waste gases, an improved molecular seal, for installation at an intermediate point in the flare stack system, comprising;

(a) a housing of larger cross-section than said flare stack, said housing closed by plates at both ends, an outlet conduit sealed through the plate at the downstream end of said housing, connected to the flare stack; an inlet conduit sealed through the plate at the upstream end of said housing, connected to the source of waste gases;

said inlet and outlet conduits enter said housing on the axis of said housing, and inside said housing said conduits are deflected at a selected angle;

whereby said two deflected conduits are substantially parallel, and their axes are in the same diametral plane;

(b) said inlet conduit extending downstream inside said housing to a point near the downstream end of, and near the top of, said housing;

(c) said outlet conduit extending upstream inside said housing to a point near the upstream end of, and near the bottom of, said housing;

whereby the downstream end of said inlet conduit is at a higher elevation than the upstream end of said outlet conduit.

4. In a flare stack system for the burning of waste gases, an improved molecular seal, for installation at an intermediate point in the flare stack system, comprising;

(a) a housing of larger cross-section than said flare stack, said housing closed by plates at both ends, an outlet conduit sealed through the plate at the downstream end of said housing, connected to the flare stack; an inlet conduit sealed through the plate at the upstream end of said housing, connected to the source of waste gases;

said housing positioned with its axis horizontal, and in which the downstream end of said inlet conduit is higher, inside said housing, than the upstream of said outlet conduit;

(b) said inlet conduit extending downstream inside said housing to a point near the downstream end of, and near the top of, said housing;

(c) said outlet conduit extending upstream inside said housing to a point near the upstream end of, and near the bottom of, said housing;

whereby the downstream end of said inlet conduit is at a higher elevation than the upstream end of said outlet conduit.

5. The molecular seal as in claim 4 in which said inlet and outlet conduits enter their appropriate ends of said housing along the axis of said housing, and wherein;

(a) inside said housing said inlet conduit makes a 90° bend upwardly and then another 90° bend horizontally near the top of said housing; and (b) inside said housing said outlet conduit makes a 90° bend downwardly and then another 90° bend horizontally near the bottom of said housing.

6. The molecular seal as in claim 5 in which said first 90° bends include a rectangular section of conduit positioned substantially in a radial direction.

7. The molecular seal as in claim 4 in which said inlet conduit enters said inlet end of said housing near the upper circumference thereof, and continues linearly into said housing, parallel and close to the upper portion of said housing wall; and said outlet conduit enters said outlet end near the lower edge thereof, and continues linearly into said housing close to, and parallel to the lower surface of housing wall.

8. The molecular seal as in claim 1 in which the cross-sectional shape of said housing is circular.

9. The molecular seal as in claim 3 in which the cross-sectional shape of said housing is rectangular and the planes of the wide faces of said rectangle are parallel to the plane through the axes of said conduits.

10. The molecular seal as in claim 3 in which the cross-sectional shape of said housing is elliptical, with the plane of the major axis substantially coincident with the plane through the axes of said conduits.

11. The molecular seal as in claim 3, in which said seal is positioned with its axis vertical, with its inlet conduit entering the upstream plate of said housing, and said outlet conduit leaving through the downstream plate of said housing.

* * * * *